US006105996A

United States Patent [19]

France

[11] Patent Number: 6,105,996

[45] Date of Patent: Aug. 22, 2000

[54] SHOE AND BINDING OF SNOWBOARD ASSEMBLY

[75] Inventor: Guillaume De France, Tullins, France

[73] Assignee: Emery S.A., St. Egreve, France

[21] Appl. No.: 09/016,759

[22] Filed: Jan. 30, 1998

Related U.S. Application Data

[63] Continuation of application No. PCT/IB96/01447, Dec. 18, 1996.

[30] Foreign Application Priority Data

Dec. 19, 1995 [CH] Switzerland ..... 3615/95
Apr. 15, 1996 [CH] Switzerland ..... 0922/96

[51] Int. Cl.[7] ..... A63C 9/08

[52] U.S. Cl. ..... 280/624; 280/618; 280/14.2

[58] Field of Search ..... 280/613, 623, 280/624, 634, 14.2, 611, 617, 618

[56] References Cited

U.S. PATENT DOCUMENTS

| | | | |
|---|---|---|---|
| 4,177,584 | 12/1979 | Beyl | 280/613 |
| 4,415,176 | 11/1983 | Hull et al. | 280/624 |
| 4,505,493 | 3/1985 | Gustavsson | 280/624 |
| 5,299,823 | 4/1994 | Glaser | 280/14.2 |
| 5,577,757 | 11/1996 | Riepl et al. | 280/624 |
| 5,782,476 | 7/1998 | Fardie | 280/14.2 |

*Primary Examiner*—Michael Mar
*Attorney, Agent, or Firm*—Wall Marjama Bilinski & Burr

[57] ABSTRACT

A boot/binding system for a snowboard wherein the boot includes a sole and transverse bar having two ends. A binding includes a base defining a horizontal plane and a median plane. The binding is selectively fixed to the board in a plurality of positions and is pivotal about an axis which is perpendicular to the horizontal plane and intersects the horizontal plane at point O. The binding includes two vertical plates arranged substantially parallel to the median plane, each of the vertical plates including a vertical groove into which one end of the transverse bar of the boot is insertable. The ends of said bar are held inside each groove by a pivoting cam elastically held in position. A first region of contact of the bar end is in contact with a front wall of the groove and the first region of contact is contained in a normal plane formed by the front wall of the groove. The normal plane is arranged perpendicular to the median plane and to the horizontal plane and the first region of contact is located at a distance in the backward direction from point O of between 0 and 30 millimeters. A second region of contact of the bar is in contact with the cam and the second region is contained in a parallelpiped volume defined by three plane sets, the plane sets comprising: (1) an M plane and an M' plane which are situated behind and parallel to the normal plane, the M plane and M' plane being respectively at a distance of 5 and 10 millimeters from the normal plane; (2) a Q plane and a Q' plane which are situated above and parallel to the horizontal plane, the Q plane and Q' plane being respectively at a distance of 12.5 millimeters and 22.5 millimeters from the horizontal plane; and, (3) an R plane and a R' plane, which are parallel to the median plane and are coplanar with each of the vertical plates, the R plane and R' plane being from 2 to 8 millimeters apart.

17 Claims, 6 Drawing Sheets

SHOE AND BINDING OF SNOWBOARD ASSEMBLY

This is a Continuation application of PCT/IB/96/1447, which in turn claims priority of Swiss Application No. CH96/000922 filed Apr. 15, 1996 and CH95/003615 filed Dec. 19, 1995.

BACKGROUND OF THE INVENTION

1. Field of the Invention

This invention relates to the field of snowboarding and more particularly to an automatic engagement system for a boot/binding assembly.

2. Discussion of the Related Art

Snowboards are well known by wintertime recreational sports enthusiasts. Snowboarders utilize a boot that is fastened to the snowboard via a binding system. Snowboard boots have arrangements of elements which cooperate with the bindings in order to facilitate a rigid connection between the boot and snowboard. A rigid connection is necessary for efficient transfer of forces, particularly lateral forces, from the boot to the snowboard.

Snowboard boots and bindings are mechanically engaged by precisely placing the boot into the binding system and then manually strapping or fastening the binding to the boot. One problem that exists with current boot/binding systems is that if the boot is not precisely placed into the binding, it is difficult if not impossible to engage the boot to the binding.

An additional problem that is encountered by snowboarders is snowpack that occurs on the binding or on the bottom of the boot. The snowpack can interfere with the precise placement and therefore the strength of the engagement of the boot to the binding. In addition, the precise placement can be effected by the wear of the bottom of the boot that occurs with the aging of the boots. Therefore, it would be beneficial to have a boot/binding system that does not require a very precise placement of the boot within the binding.

Additionally, the requirement of manually strapping or fastening the binding to the boot can be burdensome to the snowboarder. It would be very beneficial to have a boot/binding system that not only lacks the requirement of precise placement of the boot but is also able to do so automatically.

OBJECTS AND SUMMARY OF THE INVENTION

It is an object of the invention to provide an improved boot/binding assembly.

It is a further object of the invention to provide a boot/binding system that can be automatically engaged.

It is yet a further object of the invention to provide a boot/binding system that allows for a certain amount of lateral misalignment of the boot to the binding during engagement.

It is still another object of the invention to provide a boot/binding system that is unaffected by snowpack occurring under the boot during the engagement of the boot to the binding.

These and other objects are obtained by providing a boot/binding system wherein the boot includes a sole and transverse bar having two ends. A binding includes a base defining a horizontal plane and a median plane. The binding is selectively fixed to the board in a plurality of positions and is pivotal about an axis which is perpendicular to the horizontal plane and intersects the horizontal plane at point O. The binding includes two vertical plates arranged substantially parallel to the median plane, each of the vertical plates including a vertical groove into which one end of the transverse bar of the boot is insertable. The ends of said bar are held inside each groove by a pivoting cam elastically held in position. A first region of contact of the bar end is in contact with a front wall of the groove and the first region of contact is contained in a normal plane formed by the front wall of the groove. The normal plane is arranged perpendicular to the median plane and to the horizontal plane and the first region of contact is located at a distance in the backward direction from point O of between 0 and 30 millimeters. A second region of contact of the bar is in contact with the cam and the second region is contained in a parallelpiped volume defined by three plane sets, the plane sets comprising: (1) an M plane and an M' plane which are situated behind and parallel to the normal plane, the M plane and M' plane being respectively at a distance of 5 and 10 millimeters from the normal plane; (2) a Q plane and a Q' plane which are situated above and parallel to the horizontal plane, the Q plane and Q' plane being respectively at a distance of 12.5 millimeters and 22.5 millimeters from the horizontal plane; and, (3) an R plane and a R' plane, which are parallel to the median plane and are coplanar with each of the vertical plates, the R plane and R' plane being from 2 to 8 millimeters apart.

DETAILED DESCRIPTION OF THE INVENTION

Figure 1:
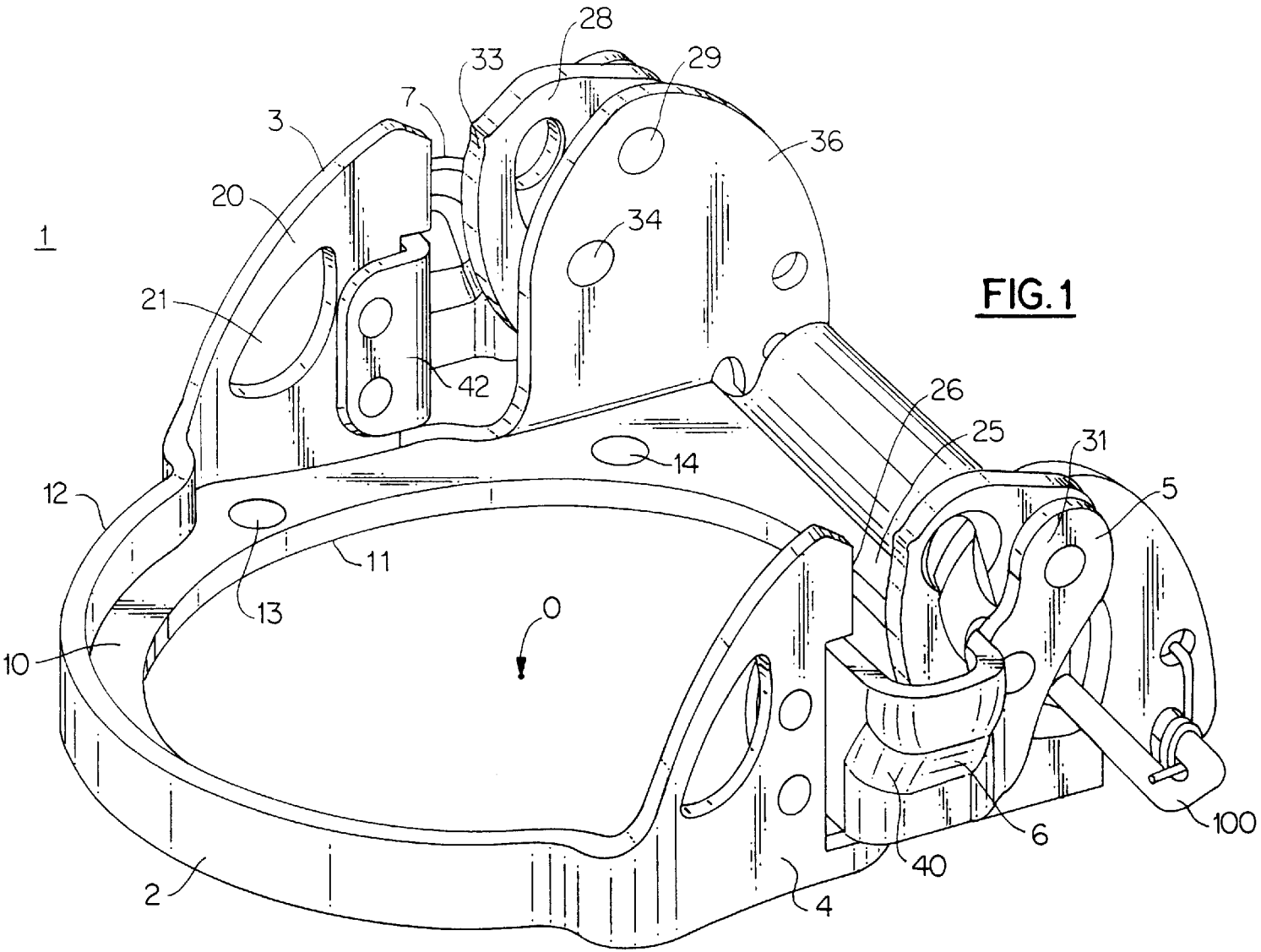
FIG. 1 is a lateral plan view of binding that embodies the present invention.
Figure 14:
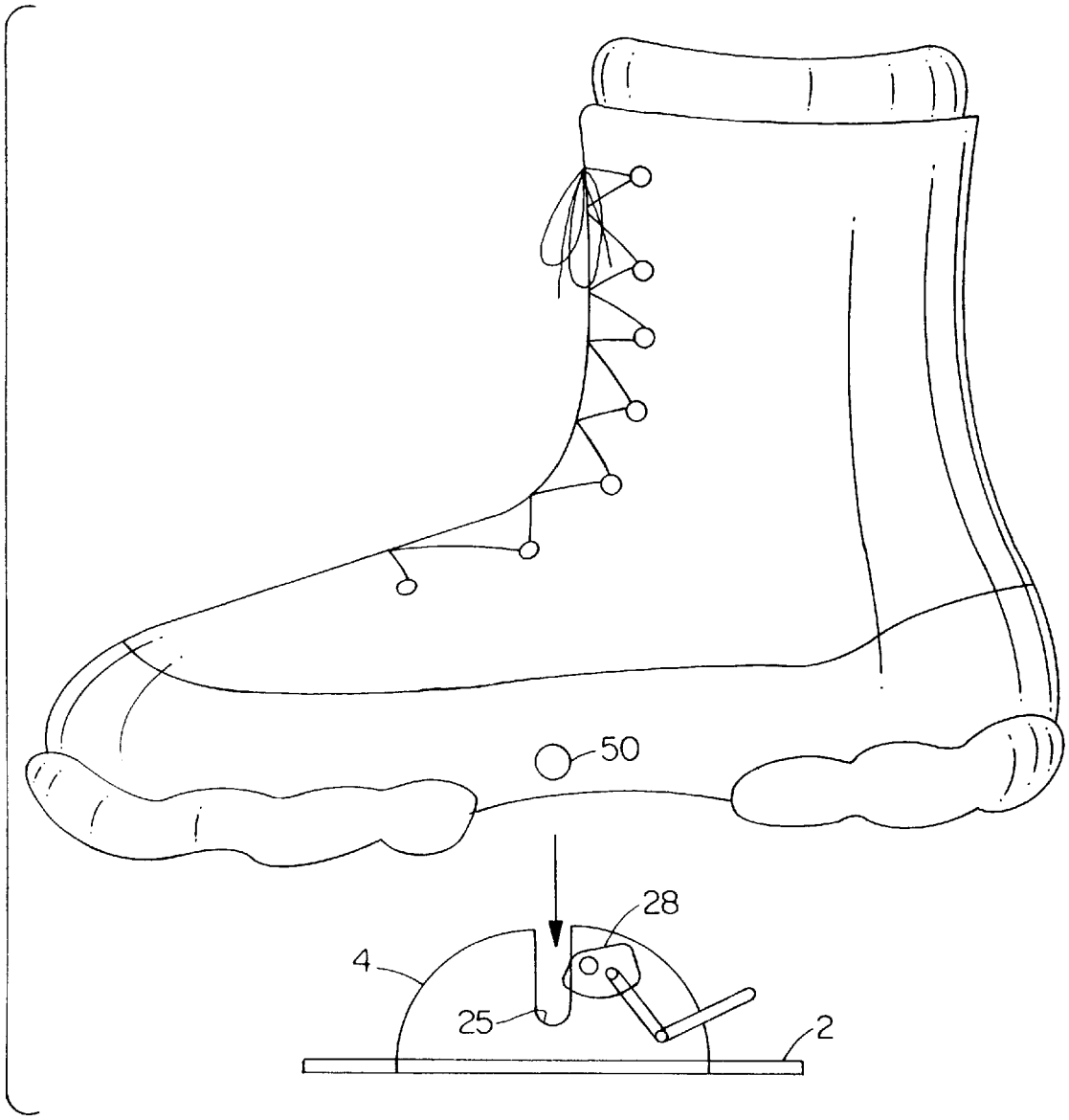
Figure 15:
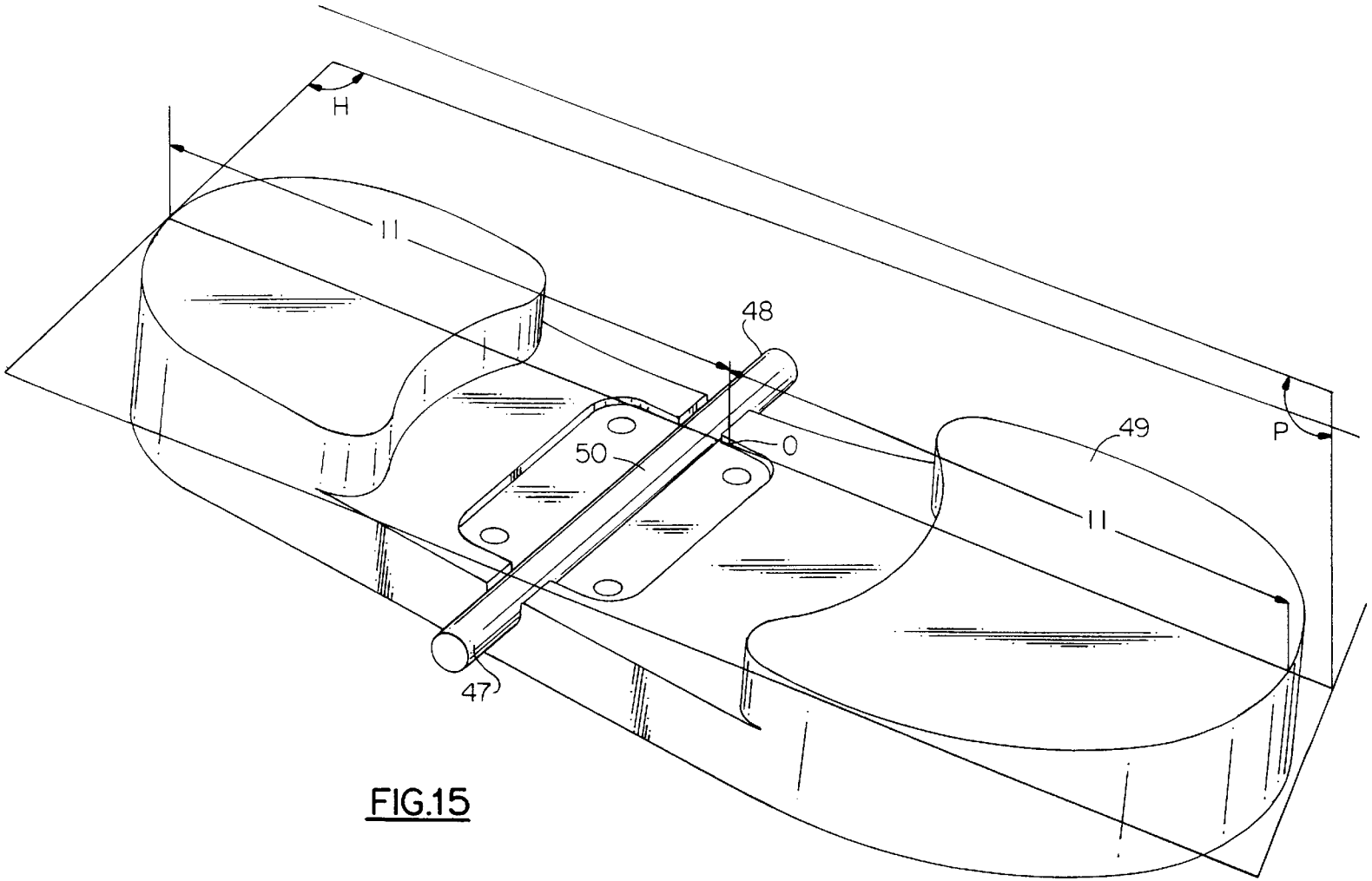
FIG. 15 is a perspective bottom view of a boot sole according to the invention.

Referring to FIG. 1, there is shown a binding 1 according to the present invention. The binding 1 has a base 2 which is intended to be fixed to the snowboard. The binding includes two vertical plates 3,4 situated laterally. The binding has a locking mechanism 5 and centering mechanisms or guides 6,7 which will be explained in more detail below. Referring now to FIGS. 14 and 15, there is shown a soft-type snowboard boot 200 which has a rigid bar 50 that is firmly fixed into the sole 49 of the boot 200. The bar 50 has two ends that are laterally situated in order to interact with the binding, as explained in more detail below. One skilled in the art would recognize that the bar 50 can be constructed of one piece or can be replaced by two sections, depending upon the particular configuration of the snowboard boot. The bar 50 interacts with the guides 6,7 and locking mechanism 5 to form a mechanical engagement of the boot 200 to the snowboard.

Referring again to FIG. 1, the base 2 has a substantially circular geometry, including a plane part 10 having a planar lower face 11 that defines a horizontal reference plane H, which is depicted in FIG. 15. The plane part 10 has a front wall 12 which extends over substantially the front half of the base 2. The reference plane H coincides with a plane formed by the top surface of the snowboard or, as is known in the art, is parallel to the top surface of the snowboard when there is an interface wedge placed between the binding and the snowboard. As shown in FIG. 15, there is a median plane P of the binding that corresponds to the median plane of the boot, which is perpendicular to plane H.

Again referring to FIG. 1, the plane part 10 includes a plurality of holes 13,14 intended to receive screws (not shown) for securing the base 2 to the snowboard. The holes 13,14 may be profiled in order to allow the user to rotate the base 2 about a vertical axis Oz which is perpendicular to plane H. The vertical axis Oz passes through point O and point O also lies in plane H and in median plane P. Point O is located midway on the sole 49 as indicated in FIG. 15.

Figure 2:
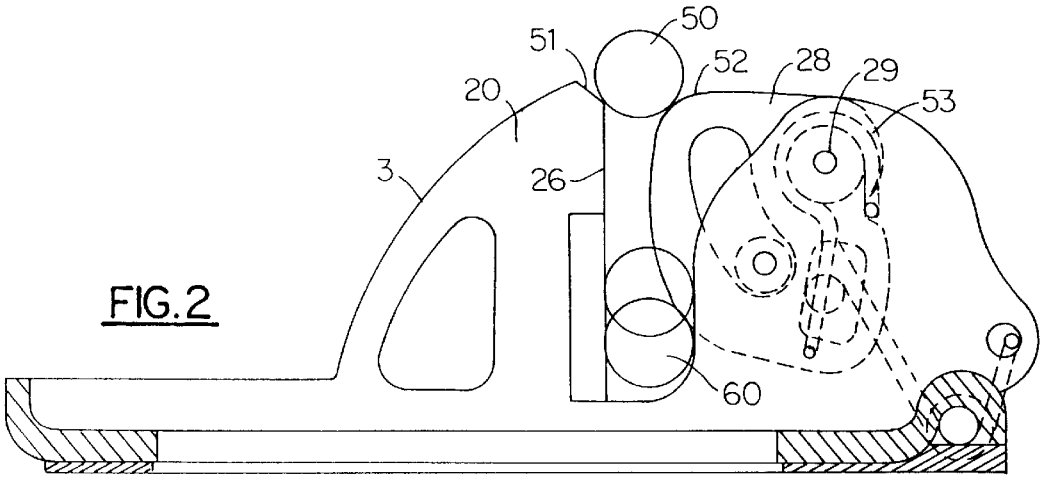
FIG. 2 is a view in section on the plane of symmetry P of the binding illustrated in FIG. 1.

The lateral regions of the binding 1 have substantially vertical portions forming symmetrical vertical plates 3,4. The vertical plates 3,4 are formed as an extension of the front wall 12 and have a front region 20. The front region 20 has an arcuate profile as opposed to a sharp-edged profile in order to help avoid any personal injury or damage to the boot. In order to reduce the overall weight of the binding 1 in the preferred embodiment, the front region 20 has a recess 21. Each of the vertical plates 3,4 has a vertical groove 25 which accepts the bar 50 of the boot 200. The groove 25 has a front vertical wall 26 formed by the vertical plate 4. The rear part of the groove 25 consists of a cam 28 which articulates about a pin 29. The pin 29 is supported by a lug 31 located outboard of the cam 28. The pin 29 constitutes an extension to the guides 6,7. Referring to FIGS. 1 and 2, the cam 28 has a front face 33 which has a curved profile that is intended to prevent the bar 50 from exiting the groove 25 after the bar 50 is placed in the bottom of the groove 25. The movement of the cam 28 relative to the pin 29 is guided by a finger 34 which is fixed and mounted on the lug 31 and a back plate 36. The finger 34 passes through a slot 39 which is formed as a quarter circle through the cam 28. The cam 28 is held in position by an elastic mechanism 53, preferably a spring-type mechanism, which is located between the plate 31 and the cam 28. The elastic mechanism 53 is also arranged around the pin 29, which serves to pivot the cam 28. In the preferred embodiment, a metal rod 100 is connected to the cams 28, one on each side of the binding 1, in order to couple the movement of the two cams 28.

The groove 25 is constructed to include means to laterally guide the bar 50 into the groove 25. The means to laterally guide the bar 50 consist of the guides 6,7 which are attached to the edge of the groove 25 and are formed from a metal piece which is cut and stamped to obtain maximum strength. The guide 6 illustrated in FIG. 1 includes a central portion having a slope directed downward and toward the center of the binding 1. This shape centers the bar 50 when the bar 50 is advanced downward into the binding 1. The guide 6 includes a central guiding part 40 that extends rearward to form a lug 31 that is used to articulate the cam 28, and extends frontward to form a bent portion 42 that is riveted to the inside front part 20 of the lateral plate 3. Preferably, a part of the bent portion 42 acts as a wall for the groove 25.

When the user advances the bar 50 toward the groove 25, the bar 25 bears on a chamfer 51 of the front part 20 and also bears on the top portion 52 of the cam 28. As the user exerts downward pressure with their foot, the bar 50 penetrates the groove 25 by pushing the cam 28 downward. The cam 28 is subject to a reaction force exerted by the elastic mechanism 53, which biases the cam into the position as depicted in FIG. 2. As the bar 50 is progressively forced downward, the bar 50 slides on the front vertical wall 26 and the cam surface 52. When the bar 50 is fully engaged and it reaches the bottom of the groove 25 (as depicted as in FIG. 2), the cam 28 rises under the action of the elastic mechanism 53 and, by means of the curved surface 33, the cam 28 locks the bar 50 into position at the bottom of the groove 25. The locked position of the cam 28 on the bar 50 is illustrated in FIGS. 4 and 5.

Figure 4:
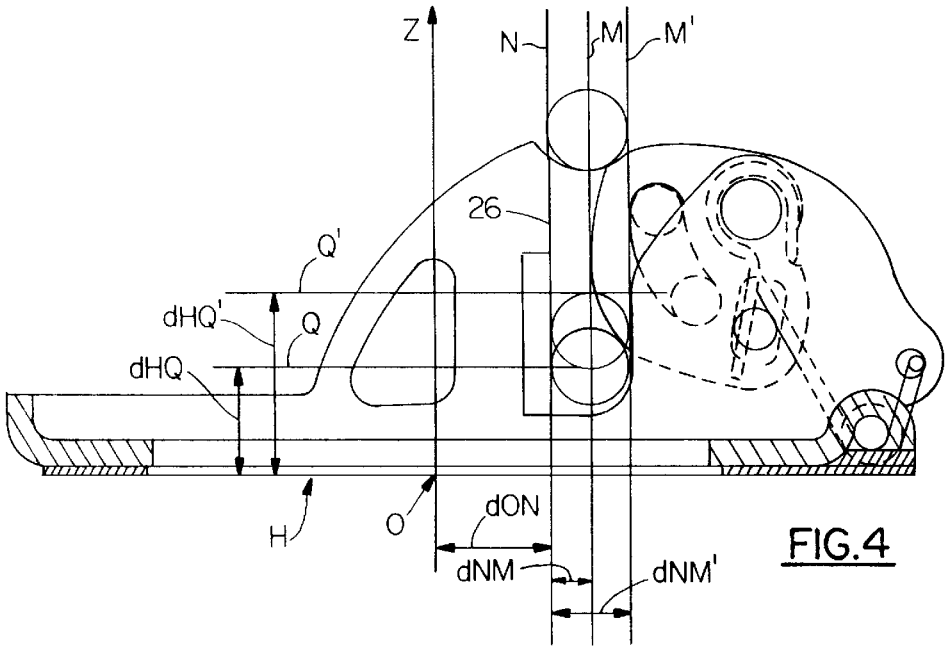
FIG. 4 is a section of FIG. 2, on which the characteristic regions of contact between the pin of the boot and the binding have been added.

When the bar 50 is in the locked position and in contact with front vertical wall 26, the point of contact of the bar 50 lies in a plane N, which is represented in FIG. 4 and is defined as being perpendicular to plane H and also perpendicular to plane P. Plane N coincides with the front vertical wall 26. The height of the point of contact of the bar 50 with the front vertical wall 26 can vary according to the geometry of the front part of the bar 50. When a cylindrical bar 50 is used, as illustrated, the point of contact is limited by the bottom part of the groove 25. It is possible to use bars with different geometries, and in those cases the point of contact may be extended. In the preferred embodiment, the distance between plane N and point O is between 0 and 30 mm. As depicted in FIG. 4, the distance between plane N and point O is 15 mm.

Figure 5:
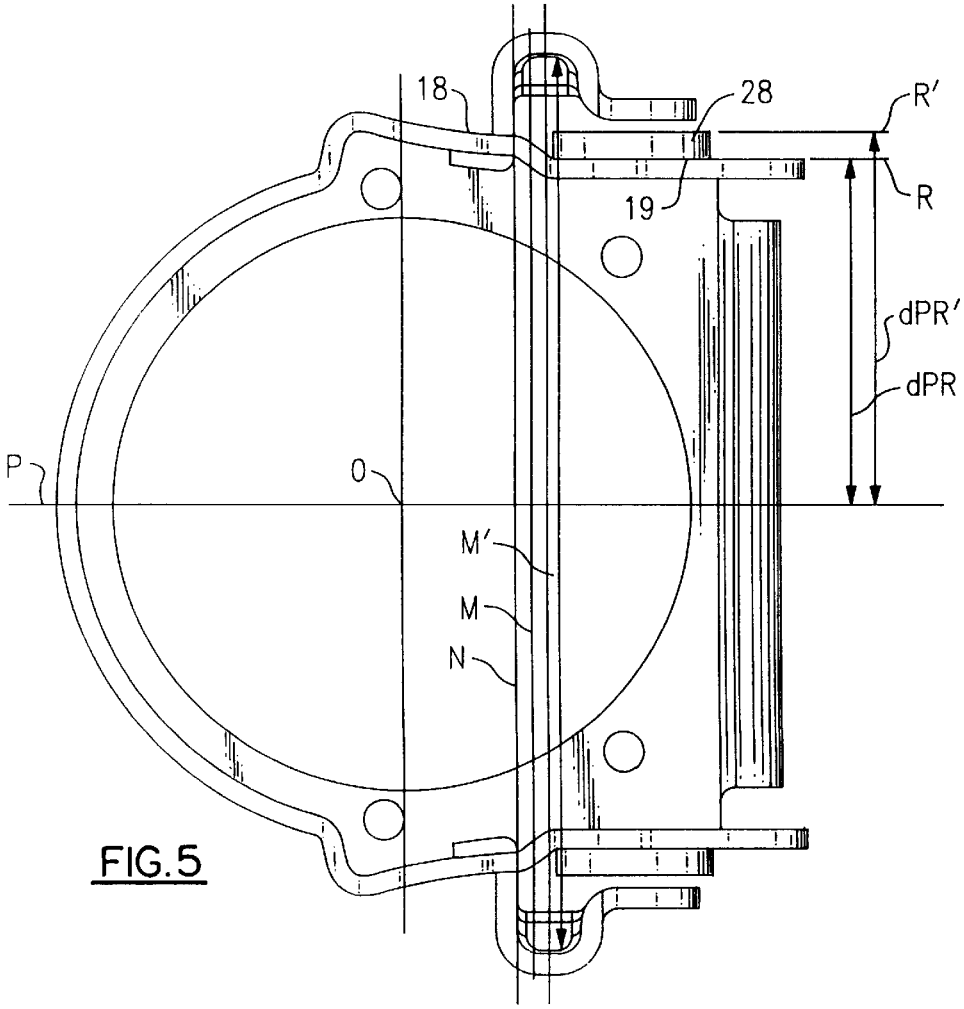
FIG. 5 is the same as the view in FIG. 3, but with the planes defining the characteristic volumes of the invention represented.

The exact positioning of the points of contact between the bar 50 and the cam 28 is contained in a parallelepipedal volume defined by a set of three pairs of parallel planes, two of which are illustrated in FIG. 4 with the third pair illustrated in FIG. 5. The limiting planes for the longitudinal position of the point of contact between the bar 50 and the cam 28 are defined as the two planes M and M' which are parallel to the plane N and situated to the rear of plane N relative to the axis Oz. In the preferred embodiment, the distance between plane N and plane M (dNM) is equal to approximately 5 mm. The distance separating plane N from plane M' (dNM') is equal to 10 mm. The distance dNM' corresponds to the diameter of a circular pin as illustrated in FIG. 4, and corresponds to the dimensions of the bottom of the groove 25.

Regarding the limiting planes for the height position of the points of contact, the limiting planes are defined by two planes Q and Q' that are parallel to plane H, as depicted in FIG. 4. The distance between plane H and plane Q (dHQ) is equal to approximately 12.5 mm, which corresponds to an embodiment wherein the sole 49 of the boot 200 has a high degree of wear (approximately 2.5 mm of the sole has eroded due to the high degree of wear). The distance between plane H and plane Q' (dHQ') is equal to approximately 22.5 mm, which corresponds to the situation wherein the boot/binding interface has a layer of snowpack accumulated therein, usually on the order of approximately 3 mm.

Regarding the limiting planes for the transverse position of the point of contact, the limiting planes are defined by R and R', which are parallel to plane P and are coincident with the lateral faces 18,19 of the cam 28, as illustrated in FIG. 5. In the preferred embodiments, a binding for an adult snowboarder would have a distance from plane P to plane R (dPR) of approximately 54 millimeters and dPR for a junior snowboarder would be approximately 45 millimeters. Of course, the distances will vary according to the size of the binding. The distance dPR–dPR' is equal to the thickness of the cam 28, which is approximately 2 to 8 millimeters.

Figure 3:
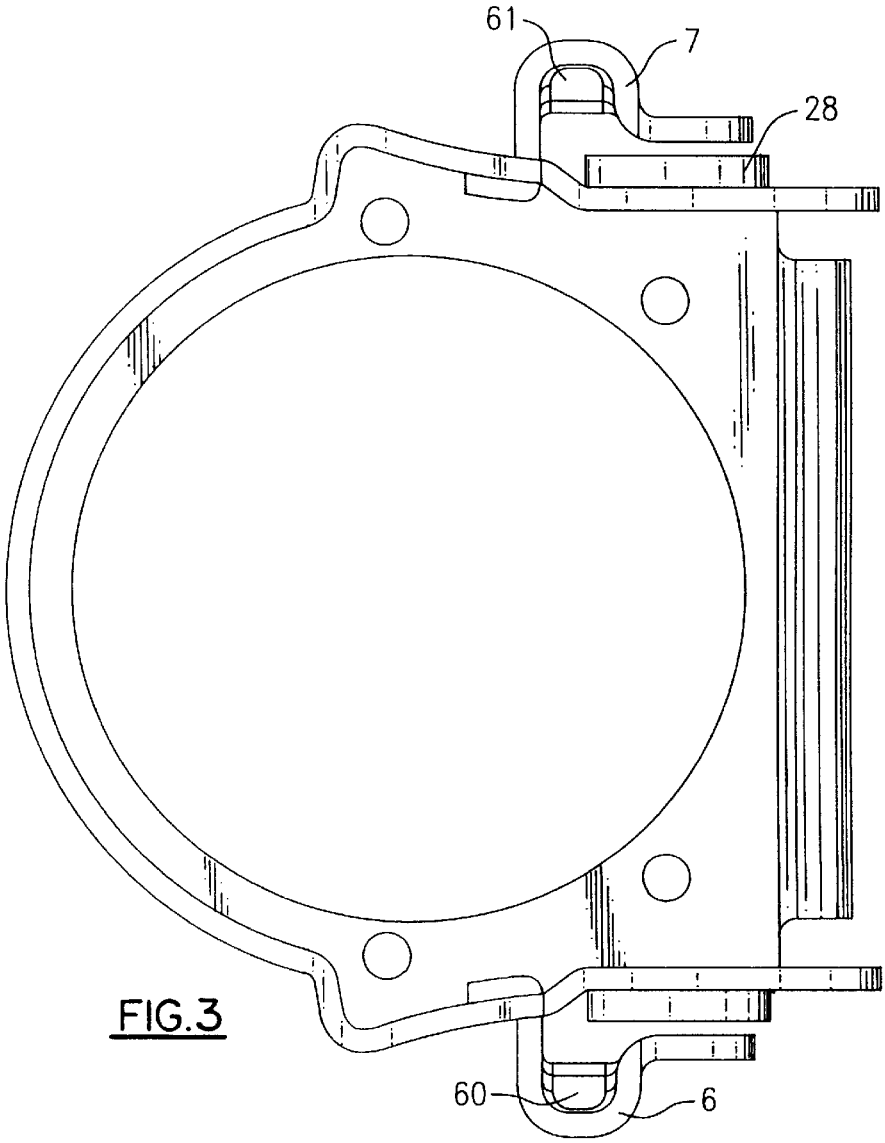
FIG. 3 is a plan view of the binding illustrated in FIG. 1.

Referring now to FIGS. 3 and 14, the binding has two guides 6,7 that are intended to guide the bar 50 of the boot 200 into position. The guides 6,7 have a sloping region 60, 61 which is intended to cooperate with the ends of the bar 50 when the boot 200 is not introduced into the binding 1 in a perfectly symmetrical position. Thus, if the boot is placed slightly offset to one side or the other, the end of the bar 50 comes into contact with the sloping region 60,61 which causes the bar 50 to travel into a median position relative to the plane of symmetry of the binding. In the preferred embodiment, the distance between the lowermost parts of the guides to each other is equal to the distance between the ends of the bar 50, so that the bar 50 is perfectly blocked laterally when it reaches the bottom position. In the preferred embodiment, the bar 50 had a diameter of 10 millimeters. An adult boot has a bar of 126 millimeters in length while a junior boot has a bar of 108 millimeters in length. The bar is preferably positioned in the sole 49 at 14 millimeters from the ground and is set back by 20 millimeters relative to point O.

Figure 6:
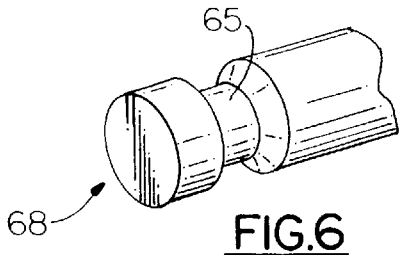
FIGS. 6 to 11 are partial views of different variants of the ends of the pins on the boot.

As mentioned above, it is important to maintain a lateral blocking effect between the boot and the binding in order to effectively transmit lateral forces from the user to the snowboard. A lateral blocking effect can also be obtained through other configurations as depicted in FIGS. 6 through 13. Referring to FIG. 6, a bar 68 may have a cylindrical shoulder 65. When the central part of the shoulder 65 comes into contact with the wall 26 and the cam 28, the regions where the diameter is increased come into contact with the plates 3, 4 and the cam 28 in order to prevent any lateral movement.

Figure 7:
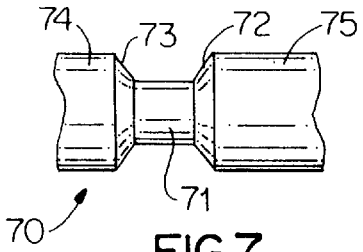

Referring to FIG. 7, the bar 70 has chamfered connection regions 72, 73 between the shoulder 71 and the regions of increased diameter 74, 75. When the boot is fitted into the binding, the chamfered parts 72, 73 have convergent slopes which accommodate a slight transverse offset due to the approximate positioning by the user.

Figure 8:
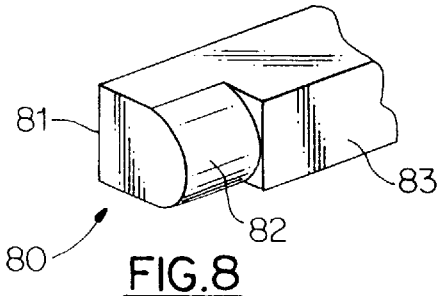

Referring to FIG. 8, the bar 80 has a plane portion 81 which is intended to come next to the wall 26 of the groove 25. The bar includes, opposite the plane face 81, a region of semicylindrical profile 82 which is intended to cooperate with the cam 28. The portion of the bar 80 which has a different geometry 83 makes it possible to obtain a lateral blocking effect.

Figure 9:
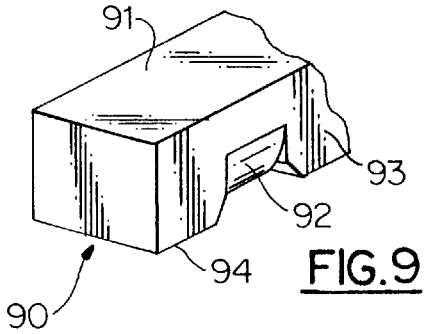

Referring to FIG. 9, the bar 90 has a plane portion 91 which is intended to come next to the wall 26 of the groove 25. The bar includes, opposite the plane face 91, a region of semicylindrical profile 92 which is intended to cooperate with the cam 28. The portion of the bar 80 which has a different geometry 93, 94 makes it possible to obtain a lateral blocking effect.

Figure 10:
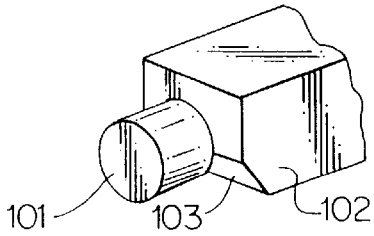
Figure 11:
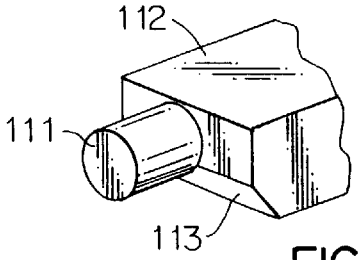

Referring to FIG. 10, the end of the bar 101 is cylindrical and connects with the central portion 102 of the bar, which has a larger geometry. The chamfered portion 103 also provides guidance when the fitting is slightly offset. The position of the cylindrical portion 101 relative to the remainder of the bar may vary according to the geometry of the binding and the boot. Similarly, referring to FIG. 11, the end of the bar 111 is cylindrical and connects with the central portion 112 of the bar, which has a larger geometry. The chamfered portion 113 also provides guidance when the fitting is slightly offset.

Figure 12:
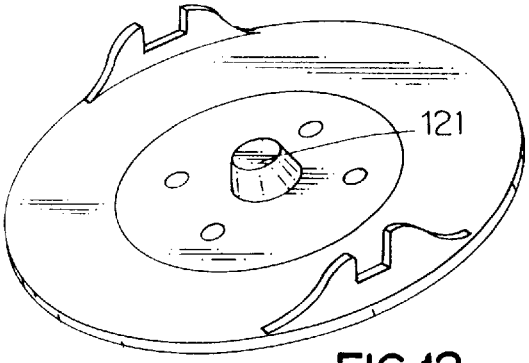
FIGS. 12 and 13 are outline perspective sketches of binding bases having means for centering the boot when it is being engaged.
Figure 13:
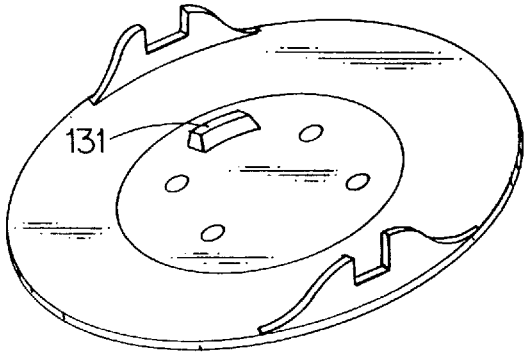

Referring now to FIG. 12, the guide means comprises a protruding element 121 which cooperates with a corresponding recess under the sole of the boot (not shown). The central element 121 has a frustoconical shape so as to provide guiding and recentering during fitting of the boot. Similarly, referring to FIG. 13, the protruding element 131 is located on the binding but can be located off-center. In this case, the element 131 assumes an arcuate shape which makes it possible to cooperate with an arcuate groove arranged under the boot (not shown). The element 131 may also be a cylindrical peg which moves inside the circular groove of the boot. This embodiment allows the element 131 to be secured to an adapter which is independent of the base of the binding itself, with the adapter remaining fixed relative to the board. When the angular orientation of the binding relative to the board is changed, the element 131 has its position offset inside the arcuate groove.

While this invention has been explained with reference to the structure disclosed herein, it is not confined to the details as set forth herein. This application is intended to cover any modifications and changes as may come within the scope of the following claims.

What is claimed is:

1. A boot/binding assembly for a snowboard, said assembly comprising:

a boot having a sole and a transverse bar which is fixed in said sole, said transverse bar having two ends; and a binding having a median plane said median plane defined by a longitudinal plane of symmetry, a forward direction, a backward direction, and a base having a lower face that defines a horizontal plane, said base selectively fixed to the snowboard in a plurality of positions, said base pivotal about an axis which is perpendicular to the horizontal plane and included in the median plane, said axis intersecting the horizontal plane at a point O, said binding including two vertical plates arranged substantially parallel to said median plane, each of said vertical plates including a vertical groove into which one end of said transverse bar of the boot is insertable, each vertical groove having front and rear vertical walls said end of said bar being held in each said groove by a curved pivoting cam having lateral faces, said cam arranged next to one of the vertical walls of said groove, said cam elastically held in a holding position; wherein a first region of contact of said bar end is in contact with said front vertical wall of said groove, said first region of contact contained in a normal plane formed by said front vertical wall of said groove, said normal plane arranged perpendicular to said median plane and to said horizontal plane, said first region of contact located at a distance in the backward direction from point O of between 0 and 30 millimeters, and wherein a second region of contact of said bar is in contact with said cam, said second region contained in a parallel piped volume defined by three plane sets, said plane sets comprising:

(1) an M plane and an M' plane which are situated behind and parallel to said normal plane, said M plane and M' plane being respectively at a distance of 5 and 10 millimeters from said normal plane;

(2) a Q plane and a Q' plane which are situated above and parallel to said horizontal plane, said Q plane and Q' plane being respectively at a distance of 12.5 millimeters and 22.5 millimeters from said horizontal plane; and (3) an R plane and a R' plane, which are parallel to said median plane and are coplanar with each lateral face of said cam, said R plane and R' plane being from 2 to 8 millimeters apart.

2. The boot/binding assembly of claim 1 wherein said transverse bar is cylindrical at said second region of contact.

3. The boot/binding assembly of claim 1 further comprising guiding means to guide the bar laterally while said boot is being engaged in said binding.

4. The boot/binding assembly of claim 3 wherein said guiding means comprises a guide arranged outside each of said grooves, said guides having an inner wall directed downward and toward said median plane, wherein a distance from the lowest point of said inner wall of said one guide to the lowest point of said inner wall of said other guide is substantially equal to the length of said bar.

5. The boot/binding assembly of claim 4 wherein the distance between the guides is 108 and 126 millimeters.

6. The boot/binding assembly of claim 1 wherein said ends of said bar are chamfered.

7. The boot/binding assembly of claim 1 wherein said ends of said bar include partially cylindrical shoulder.

8. The boot/binding assembly of claim 7 wherein said shoulder is chamfered.

9. The boot/binding assembly of claim 1 wherein said base includes a protruding element, said element configured to interact with a complementary housing located on said boot.

10. The boot/binding assembly of claim 9 wherein said element has a frustoconical shape.

11. The boot/binding assembly of claim 9 wherein said element is located at a center of said base.

12. The boot/binding assembly of claim 9 wherein said element is arcuately shaped.

13. The boot/binding assembly of claim 1 wherein said binding includes an adapter for selectively fixing said base to the snowboard.

14. The boot/binding assembly of claim 13 wherein said adapter includes a protruding element, said element configured to interact with a complementary housing located on said boot.

15. The boot/binding assembly of claim 14 wherein said element has a frustoconical shape.

16. The boot/binding assembly of claim 14 wherein said element is located at a center of said base.

17. The boot/binding assembly of claim 16 wherein said element is arcuately shaped.

* * * * *